US006832599B2

(12) United States Patent
Ibrahim et al.

(10) Patent No.: US 6,832,599 B2
(45) Date of Patent: Dec. 21, 2004

(54) FUEL SYSTEM FOR AN INTERNAL COMBUSTION ENGINE

(75) Inventors: Daniel R. Ibrahim, Bloomington, IL (US); Amy M. Hess, Metamora, IL (US); Alan R. Stockner, Metamora, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/412,219

(22) Filed: Apr. 14, 2003

(65) Prior Publication Data

US 2004/0200454 A1 Oct. 14, 2004

(51) Int. Cl.[7] ..... F02M 55/00
(52) U.S. Cl. ..... 123/456; 123/446; 123/467
(58) Field of Search ..... 123/456, 446, 123/447, 467

(56) References Cited

U.S. PATENT DOCUMENTS 5,121,730 A * 6/1992 Ausman et al. ..... 123/467
5,168,855 A 12/1992 Stone
5,311,850 A 5/1994 Martin
5,433,182 A * 7/1995 Augustin et al. ..... 123/456
5,671,711 A * 9/1997 Collie ..... 123/299
5,832,954 A 11/1998 Shafer
5,954,031 A * 9/1999 Ogiso et al. ..... 123/447
5,954,032 A * 9/1999 Augustin et al. ..... 123/456
6,408,828 B1 6/2002 Wheeler

FOREIGN PATENT DOCUMENTS

DE 10061873 6/2002
DE 10114219 9/2002

* cited by examiner

*Primary Examiner*—Weilun Lo
(74) *Attorney, Agent, or Firm*—Finnegan, Henderson, Farabow, Garrett & Dunner

(57) ABSTRACT

A fuel system for an internal combustion engine includes at least four fuel injectors for supplying fuel to corresponding combustion chambers of the engine and a pump assembly in fluid communication with the fuel injectors and supplying working fluid to the fuel injectors. The fuel system further includes at least three high pressure rails fluidly connected between the pump assembly and the at least four fuel injectors.

46 Claims, 5 Drawing Sheets

FUEL SYSTEM FOR AN INTERNAL COMBUSTION ENGINE

Technical Field

This invention relates generally to fluid systems for internal combustion engines, and more particularly to a high pressure rail assembly of a fuel system of an internal combustion engine.

BACKGROUND

Two common types of fuel systems for internal combustion engines include hydraulically-actuated-electronically-controlled unit injector type fuel systems and common rail type fuel systems. In some hydraulically-actuated-electronically-controlled unit injector type fuel system, working fluid, such as hydraulic oil, is supplied from a high pressure pump to two high pressure rails or collection chambers. The high pressure rails are connected to the fuel injectors of the fuel system and deliver the high pressure working fluid to a fuel injector upon actuation of the injector. The high pressure working fluid enters the fuel injectors and urges an intensifier piston of the injector to pressurize fuel located in a fuel chamber of the fuel injector. The pressurized fuel then exits the tip of the injector into a combustion chamber of the engine. U.S. Pat. No. 5,168,855 to Dwight V. Stone discloses a hydraulically-actuated-electronically-controlled unit injector type fuel system including two high pressure rails.

Similar to the hydraulically-actuated-electronically-controlled unit injector type fuel systems, some common rail fuel systems include two high pressure rails supplying working fluid to the fuel injectors. In this system, however, the working fluid is pressurized fuel. Accordingly, the fuel injectors do not include an intensifier piston, but rather perform essentially as a gate for supplying the pressurized fuel from the high pressure rails to the combustion chambers of the engine.

Maintaining the pressure of the fluid in the high pressure rails as constant as possible is a requirement for efficient engine operation of both the hydraulically-actuated-electronically-controlled unit injector and common rail type fuel systems. The amount of fuel that is injected into a combustion chamber by a fuel injector is directly dependent on the pressure of the working fluid in the high pressure rails. Accordingly, pressure fluctuations in the high pressure rails can cause the fuel injector to inject more or less fuel than is needed by the engine, thus detrimentally affecting engine performance.

One problem in maintaining consistent fluid pressure in the high pressure rail is the fact that each injection event inherently causes a quick drop in the fluid pressure of a high pressure rail because working fluid from the rail quickly exits the rail and flows into a fuel injector. Even further, the pressure fluctuations caused by one injection event can join with pressure fluctuations caused by previous or subsequent injection events to intensify the pressure fluctuations. Further, these pressure fluctuations may include peak pressures that can stress the components of the high pressure rail and thereby affect the design requirements of the fuel system.

U.S. Pat. No. 5,168,855 provides a system that reduces pressure fluctuations in a hydraulically-actuated-electronically-controlled unit injector type fuel system having two high pressure fluid rails. The '855 patent discloses one high pressure rail on each side of the engine. A Helmholz resonance isolation type valve is located in the lines connecting each high pressure rail to a high pressure pump. The Helmholz resonance isolation type valve includes a one-way check valve and an orifice in parallel flow communication. The Helmholz type valve acts to limit pressure fluctuations from flowing from one high pressure rail to the other high pressure rail. One drawback feature of the fuel system of the '855 patent is that the pressure fluctuations caused by a fuel injector on one side of the engine are not isolated from the other injectors located on the same side of the engine.

The present invention provides a fuel system for an internal combustion engine that avoids some or all of the aforesaid shortcomings in the prior art.

SUMMARY OF THE INVENTION

In accordance with one aspect of the invention, a fuel system for an internal combustion engine includes at least four fuel injectors for supplying fuel to corresponding combustion chambers of the engine, and a pump in fluid communication with the fuel injectors and supplying working fluid to the fuel injectors. The fuel system further includes at least three high pressure rails fluidly connected between the pump and the at least four fuel injectors.

According to another aspect of the present invention, a method for reducing pressure fluctuations in a fuel system of an internal combustion engine includes supplying working fluid from a high pressure pump to at least three high pressure rails, and supplying fuel injectors of the engine with working fluid from the at least three high pressure rails.

According to yet another aspect of the present invention, a method for supplying working fluid to a group of fluid control valves of an internal combustion engine includes supplying working fluid from a high pressure pump to at least a first, second and third high pressure rail. The method further includes passing working fluid from the first high pressure rail through a fluid control valve of a first group of fluid control valves, passing working fluid from the second high pressure rail through a fluid control valve of a second group of fluid control valves after said passing of working fluid through a fluid control valve of the first group of fluid control valves, and passing working fluid from the third high pressure rail through a fluid control valve of a third group of fluid control valves after said passing of working fluid through a fluid control valve of the second group of fluid control valves.

DETAILED DESCRIPTION

Reference will now be made in detail to the drawings. Wherever possible, the same reference numbers will be used throughout the drawings to refer to the same or like parts.

Figure 1:
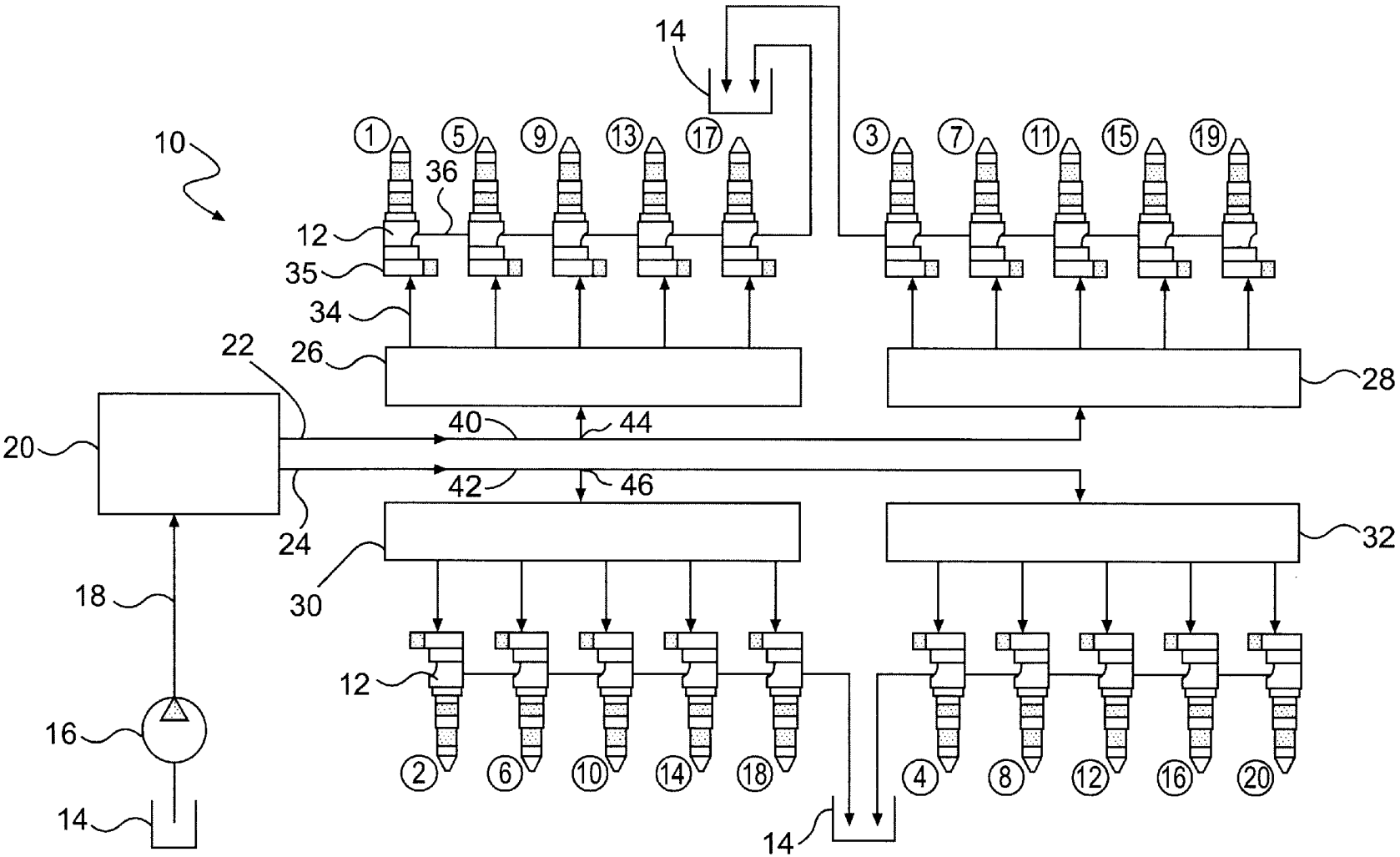
FIG. 1 is a schematic illustration of a portion of a fuel system of an internal combustion engine according to the disclosure.

FIG. 1 illustrates a fluid circuit 10 for a fuel system of an internal combustion engine. The fluid circuit 10 may provide high pressure hydraulic fluid, such as hydraulic oil or engine oil, to hydraulically actuated unit fuel injectors 12 in an arrangement commonly referred to as a hydraulically-actuated-electronically-controlled unit injector type fuel system. Alternatively, fluid circuit 10 may provide high pressure fuel to the fuel injectors 12 in accordance with an arrangement typically referred to as a common rail type fuel system. The fluid utilized in the fluid circuit 10, be it hydraulic oil, engine oil or fuel, will hereinafter be generically referred to as working fluid.

Fluid circuit 10 may include a source of low pressure working fluid 14, for example, the engine's lubricating oil sump or the engine's fuel tank. A supply pump 16 may be fluidly connected through a low pressure supply line 18 to supply working fluid to a high pressure pump assembly 20. Pump assembly 20 may be of any common type, such as an axial piston pump or radial piston pump. Further, the high pressure pump assembly 20 may be of the variable displacement type, fixed displacement type, or of the fixed displacement, variable delivery type. Also, the high pressure pump assembly 20 may include a single pump unit or multiple pump units.

An outlet of pump assembly 20 is connected to two high pressure working fluid supply lines 22, 24, each of which are fluidly connected at opposite sides of the engine to high pressure rails 26, 28, 30, 32. The high pressure rails 26, 28, 30, 32 as described herein include collection chambers separate from the high pressure working fluid supply lines 22, 24 that receive and store a volume of working fluid to be delivered to the fuel injectors 12 upon actuation of the fuel injectors 12.

Reference will now be made to the components of a single high pressure rail 26, with the understanding that similar components are associated with the remaining high pressure rails 28, 30, 32. The high pressure rail 26 may include a series of branches 34 fluidly connecting the high pressure rail 26 to a series of the fuel injectors 12. As shown in FIG. 1, the high pressure rail 26 may include five branches 34, each connecting to one of five fuel injectors 12. Each fuel injector 12 includes a fluid control valve 35 for controlling the passing of working fluid from the high pressure rail 26 through the branch 34 and into the fuel injector 12. The fluid circuit 10 further includes a return line 36 connecting the fuel injectors 12 back to the source of low pressure working fluid 14.

The fuel system shown in FIG. 1 includes a total of twenty fuel injectors 12, thus forming a V-20 engine. As noted above, two high pressure rails 26, 28 may be formed on one side of the engine, and two other high pressure rails 30, 32 may be located on the other side of the engine. In accordance with the present disclosure, more high pressure rails may be located on each side of the engine. For example, the V-20 engine may include as many as five high pressure fluid rails located on each side of the engine, with each rail being connected to an equal or unequal number of fuel injectors 12.

Referring again to FIG. 1, each high pressure working fluid supply line 22, 24 is connected to a common outlet of the high pressure pump assembly 20. Each supply line 22, 24 further includes a common supply line portion 40, 42 located between the high pressure pump assembly 20 and a split 44, 46. Individual supply line portions extend from the split 44, 46 to each individual high pressure rail 26, 28, 30, 32. Accordingly, the rails 26, 28 and 30, 32 located on each side of the engine are only fluidly connected to one another via the common supply line portions 40 and 42. Alternatively, common supply line portions 40 and 42 may be arranged to fluidly connect high pressure rails located on opposite sides of the engine.

Figure 2:
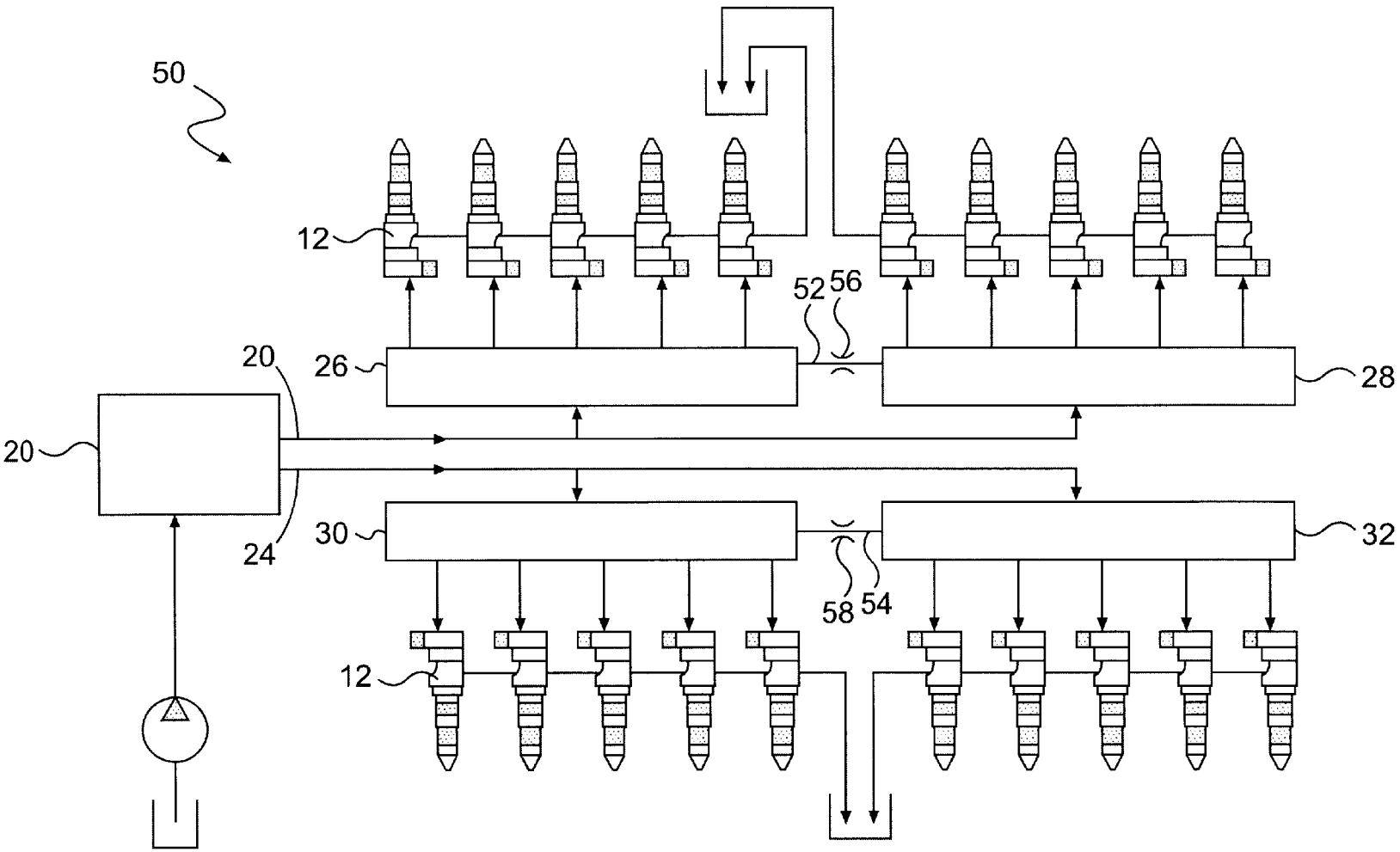
FIG. 2 is a schematic illustration of a portion of an alternative arrangement of a fuel system of an internal combustion engine according to the disclosure.

FIG. 2 shows an alternative arrangement for the fuel system described above with respect to FIG. 1. The fluid circuit 50 of FIG. 2 may include all of the aspects described above regarding the fluid circuit 10 of FIG. 1, except for the addition of a bridge line 52, 54 fluidly connecting adjacent high pressure rails 26, 28 and 30, 32 located on each side of the engine. Each bridge line 52, 54 may include an orifice 56, 58 providing a fixed flow restriction between the adjacent high pressure rails 26, 28 and 30, 32 on each side of the engine. Alternatively, bridge lines 52, 54 may extend between high pressure rails located on opposite sides of the engine.

Figure 3:
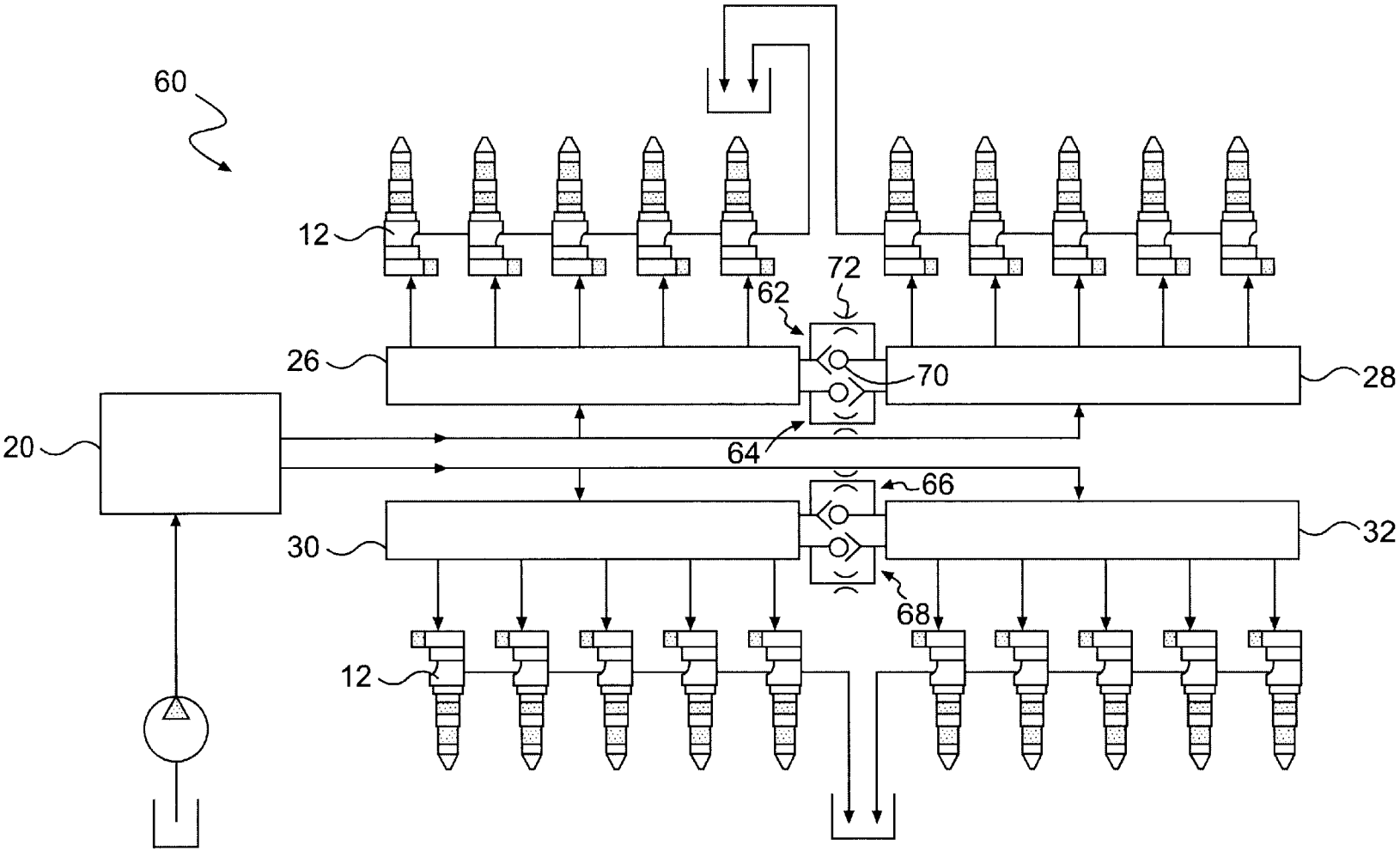
FIG. 3 is a schematic illustration of a portion of another alternative arrangement of a fuel system of an internal combustion engine according to the disclosure.

FIG. 3 shows an alternative arrangement for the fuel system described above with respect to FIG. 1. The fluid circuit 60 of FIG. 3 may include all of the aspects described above regarding the fluid circuit 10 of FIG. 1, except for the addition of a Helmholz bridge forming a fluid connection between at least two high pressure rails 26, 28, 30, 32. The Helmholz bridge may include two Helmholz resonance isolation valves 62, 64 and 66, 68 connecting adjacent high pressure rails 26, 28 and 30, 32 on each side of the engine. As shown schematically in FIG. 3, each Helmholz resonance isolation valve 62, 64, 66, 68 may include a one-way check valve 70 and an orifice 72 connected in parallel to the check valve 70. The orifice 72 may be formed as an orifice extending through the check of the check valve 70 or, as shown in FIG. 3, as a separate flow passage around the one-way check valve 70. Further, the two Hemholz resonance isolation valves 62, 64 and 66, 68 may share a single orifice. The adjacent Helmholz resonance isolation valves 62, 64 and 66, 68 on each side of the engine may include oppositely oriented check valves 70 to allow fluid communication in both directions between the adjacent high pressure rails 26, 28 and 30, 32. It is understood that the Helmholz resonance isolation valves 62, 64 and 66, 68 may be configured to extend between high pressure rails located on opposite sides of the engine. Further, the fluid connection formed by each Helmholz bridge may include one or more conduits extending from the connected high pressure rails. FIG. 3 illustrates Helmholz bridges with two conduits extending from each high pressure rail.

Figure 4:
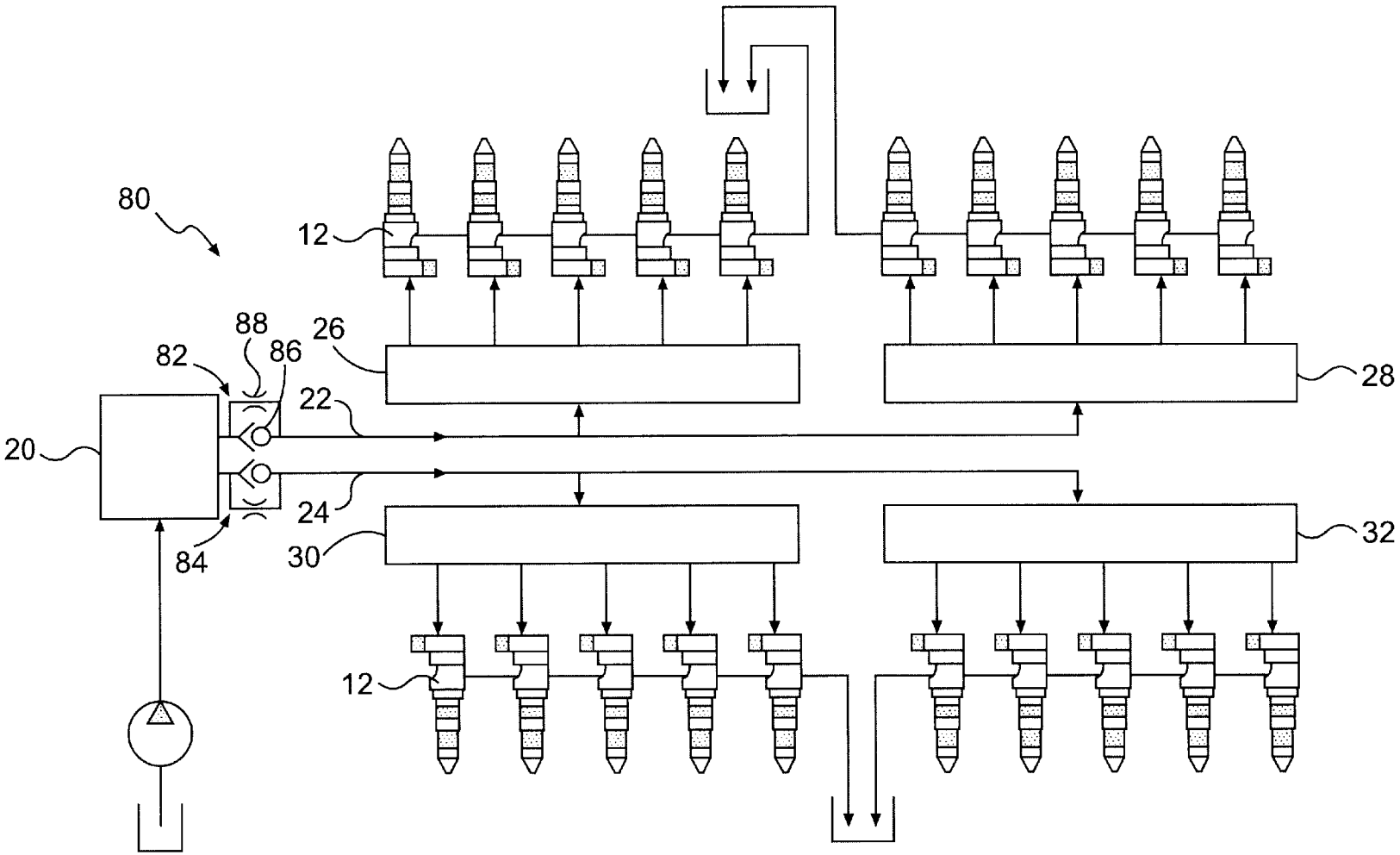
FIG. 4 is a schematic illustration of a portion of yet another alternative arrangement of a fuel system of an internal combustion engine according to the disclosure.

FIG. 4 shows another alternative arrangement for the fuel system described above with respect to FIG. 1. The fluid circuit 80 of FIG. 4 may include all of the aspects described above regarding the fluid circuit 10 of FIG. 1, except for the addition of Helmholz resonance isolation valves 82, 84 connected to each high pressure supply line 22, 24 adjacent the outlet of the high pressure pump assembly 20. As described above with respect to the arrangement of FIG. 3, each Helmholz resonance isolation valve 82, 84 may include a one-way check valve 86 and an orifice 88 formed parallel to the check valve 86. The orifice 88 may be formed as an orifice extending through the check of the check valve 86 itself or, as shown in FIG. 4, as a separate flow passage around the one-way check valve 86. Each of the check valves 86 are oriented to prohibit fluid flow from the high pressure rails 26, 28, 30, 32 back to the high pressure pump assembly 20.

Figure 5:
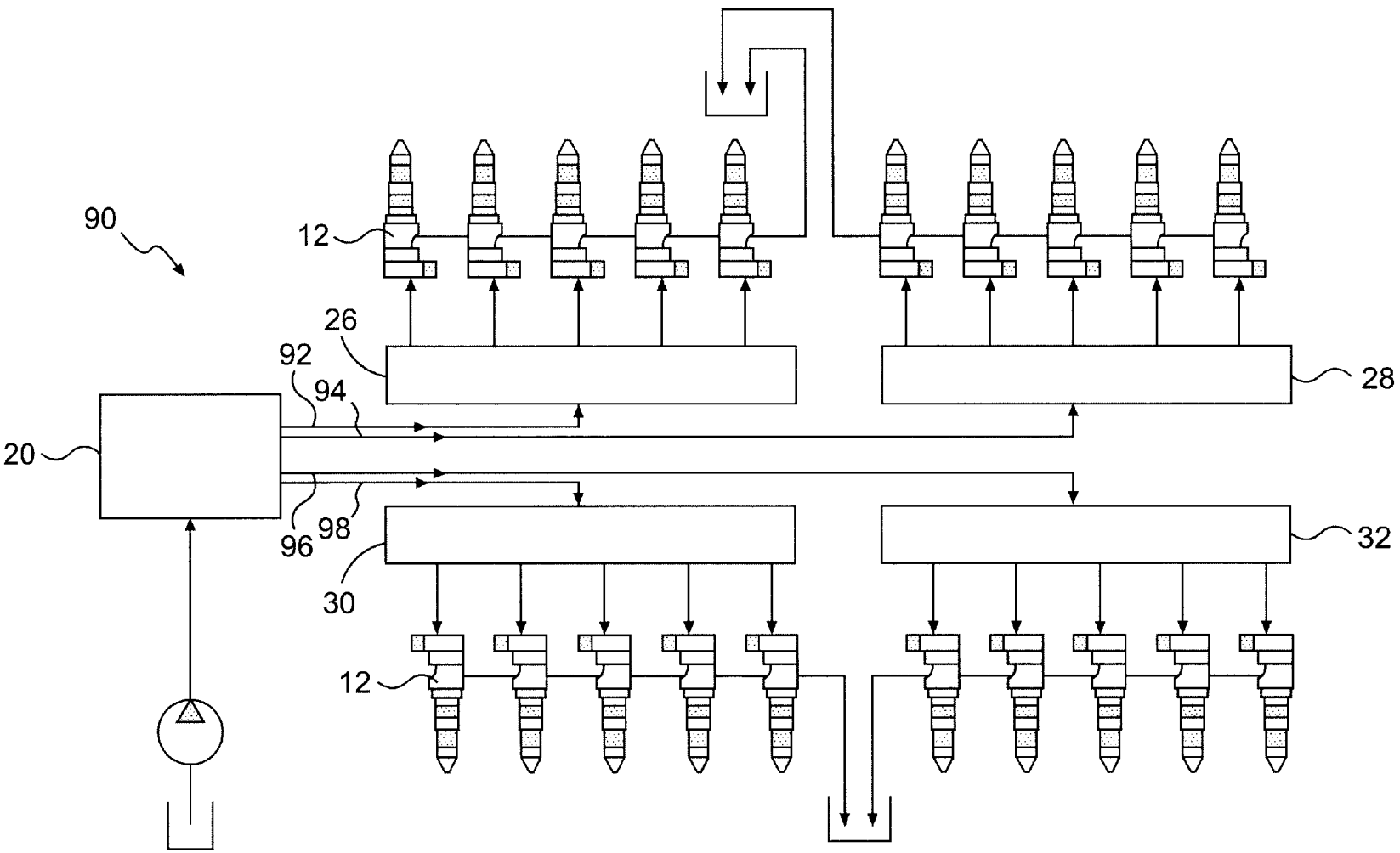
FIG. 5 is a schematic illustration of a portion of still another alternative arrangement of a fuel system of an internal combustion engine according to the disclosure.

FIG. 5 shows yet another alternative arrangement for the fuel system described above with respect to FIG. 1. The fluid circuit 90 of FIG. 5 may include all of the aspects described above with respect to the fluid circuit 10 of FIG. 1, except that the high pressure supply lines 22, 24 are replaced with individual supply lines 92, 94, 96, 98 extending from the outlet of the high pressure pump assembly 20 to each high pressure rail 26, 28, 30, 32.

It is understood that features of the different fuel systems 10, 50, 60, 80 and 90 of FIGS. 1–5 may be combined to form alternative fuel systems. For example, the bridge lines 52, 54 of FIG. 2 or the Helmholz bridges of FIG. 3 may be included in the fuel systems of FIGS. 1, 4 and 5 to provide a fluid connection between two high pressure rails. Further, the Helmholz resonance valves 82 and 84 of the fuel system of FIG. 4 may be included in each of the high pressure supply lines 92, 94, 96 and 98 of the fuel system of FIG. 5.

Industrial Applicability

Referring now to the operation of the fluid circuit 10 of FIG. 1, supply pump 16 draws working fluid from the source of low pressure working fluid 14 and delivers the working fluid through the low pressure supply line 18 to high pressure pump assembly 20. High pressure pump assembly 20 then pressurizes the working fluid and supplies the pressurized working fluid through the high pressure working fluid supply lines 22, 24 to the high pressure rails 26, 28 and 30, 32 located on each side of the engine. Actuation of an individual fuel injector 12 is initiated by opening the fluid control valve 35 of the fuel injector 12 to allow working fluid to flow or pass through the branch 34 located between the fuel injector 12 and its respective high pressure rail 26, 28, 30, 32, and into the individual fuel injector 12.

In a hydraulically-actuated-electronically-controlled unit injector type fuel system, the working fluid entering the fuel injector 12 acts on an intensifier piston (not shown) to pressurize fuel in a fuel chamber (not shown) of the fuel injector and inject the pressurized fuel into a combustion chamber (not shown) of the engine. Alternatively, in a common rail fuel system, the high pressure rails 26, 28, 30, 32 supply pressurized fuel to the fuel injectors 12, and upon actuation of a fuel injector 12, the fuel thereafter travels through the injector and is injected into a combustion chamber of the engine. The injectors may be coupled to the source of low pressure working fluid 14 through return lines 36 so as to drain the bypass flow from the fuel injectors 12.

The timing and duration of the actuation of each fuel injector 12 is determined by the control system of the engine (not shown), as is known in the art. The actuation timing and duration may vary based on a number of sensed engine conditions, such as engine load, engine temperature, engine crankshaft position, and fluid pressure in the high pressure rails, 26, 28, 30, 32. The fluid pressure in the high pressure rails 26, 28, 30, 32, however, may fluctuate as a result of the supplying of working fluid to the fuel injectors 12 upon actuation of a fuel injector 12. The use of at least two separate high pressure rails 26, 28 and 30, 32 on each side of the engine, in accordance with the present disclosure, minimizes the effects of the pressure fluctuations by partially isolating the pressure fluctuations created in one high pressure rail 26, 28, 30, 32 from the remaining high pressure rails 26, 28, 30, 32. The use of four separate high pressure rails reduces the number of fuel injectors 12 coupled to a high pressure rail, and thus reduces the influence of a fuel injector actuation on the remaining fuel injectors 12. Accordingly, pressure fluctuations caused by one high pressure rail 26, 28, 30, 32 must travel from the high pressure rail 26, 28, 30, 32 along the high pressure working fluid supply lines 22, 24, to the split 46 of the supply line 22, 24 and then to the adjacent high pressure rail 26, 28, 30, 32 before affecting the adjacent high pressure rail 26, 28, 30, 32.

Pressure fluctuations of the working fluid are further reduced when the firing order of the fuel injectors 12 is selected so that actuation of a fuel injector 12 associated with a particular high pressure rail 26 is separated from actuation of another fuel injector 12 associated with the same high pressure rail 26. As noted above, actuation of a fuel injector 12 is initiated by opening the fluid control valve 35 of the fuel injector 12 so that working fluid passes from a respective high pressure rail 26, 28, 30, 32, through the corresponding branch 34, and into the fuel injector 12. The maximum separation of injection events in a high pressure rail is achieved by serially alternating actuation of a fuel injector 12 between each of the high pressure rails 26, 28, 30, 32. Such a firing order is shown in FIG. 1 by the circled numbers 1–20.

Fluid circuit 50 illustrated in FIG. 2 operates in generally the same manner as the fluid circuit 10 of FIG. 1, except that the bridge lines 52, 54 allow additional fluid flow between adjacent high pressure rails 26, 28 and 30, 32 located on the same side of the engine. The orifices 56, 58, however, restrict the amount of fluid communication between adjacent high pressure rails 26, 28 and 30, 32 so that large pressure fluctuations are not transferred between the rails. The limited fluid communication between adjacent high pressure rails 26, 28 and 30, 32 provides for a less rigid fluid circuit 50, thereby allowing pressure fluctuations in the high pressure rails 26, 28, 30, 32 to dissipate faster.

Fluid circuit 60 illustrated in FIG. 3 operates in a similar manner to the fluid circuit 10 of FIG. 1, except for the additional fluid communication between adjacent high pressure rails 26, 28 and 30, 32 provided by the Helmholz resonance isolation valves 62, 64 and 66, 68 between adjacent high pressure rails 26, 28 and 30, 32. The check valves 70 of the Helmholz resonance isolation valves 62, 64 and 66, 68 provide greater communication between adjacent high pressure rails 26, 28 and 30, 32 when pressure fluctuations in a high pressure rail 26, 28, 30, 32 reach above a predetermined magnitude. The predetermined magnitude is a function of the force biasing the check of the check valve 70 in its closed position. Thus, if pressure fluctuations in a high pressure rail 26, 28, 30, 32 are below the predetermined magnitude, fluid flow between adjacent high pressure rails will be limited to flow through orifices 72, but when the fluctuations exceed the predetermined magnitude, greater fluid flow between the adjacent high pressure rails 26, 28 and 30, 32 is achieved by the opening of the check valve 70. The use of the Helmholz resonance isolation valves 62, 64, 66, 68 provides for a quick dissipation of pressure fluctuations that achieve a resonance within a high pressure rail 26, 28, 30, 32.

Fluid circuit 80 illustrated in FIG. 4 operates in a similar manner to the fluid circuit 10 of FIG. 1, except that limited flow between adjacent high pressure rails 26, 28, 30, 32 is replaced with limited flow between high pressure rails located on opposite sides of the engine via Helmholz resonance isolation valves 82, 84 located adjacent the high pressure pump assembly 20. Accordingly, high pressure rails 26, 28 located one side of the engine have limited fluid communication with the high pressure rails 30, 32 located on the other side of the engine through orifices 88. As with the fluid circuit of FIG. 2, the limited fluid flow across different sides of the engine may provide for a less rigid fluid circuit, thereby allowing pressure fluctuations in the high pressure rails 26, 28, 30, 32 to dissipate faster.

Finally, the operation of fluid circuit 90 allows fluid communication between each of the high pressure rails 26, 28, 30, 32 at the outlet of the high pressure pump assembly 20. Accordingly, pressure fluctuations emanating from a high pressure rail 26, 28, 30, 32 must travel along its individual supply line 92, 94, 96, 98 to the outlet of the pump assembly 20 and back out another of the supply lines 92, 94, 96, 98 before it influences another high pressure rail 26, 28, 30, 32. The extended flow path between high pressure rails 26, 28, 30, 32 reduces the effect of pressure fluctuations in one high pressure rail on another high pressure rail.

Other embodiments of the invention will be apparent to those skilled in the art from consideration of the specification and practice of the invention disclosed herein. For example, the fluid system described herein may be used in connection with fluid systems other than the fuel system of an internal combustion engine. For example, the fluid system described herein may be used to pass high pressure working fluid through a series of fluid control valves other than the fluid control valves of a fuel injector. Such alternative fluid control valves could be associated with, for example, hydraulically driven intake and exhaust valves of a camless engine.

Further, the arrangements disclosed may be applied to various engine sizes, such as V-4, V-6, V-8 and V-16 engines. In a V-4 arrangement, four high pressure rails may be used, one for each of the injectors. Further, in a V-6 arrangement, three high pressure rails may be used with each rail connected to one, two or three fuel injectors. Further, among the various engine sizes, an equal or unequal number of injectors may be connected to individual high pressure rails. For example, a V-16 engine may include three high pressure rails on each side of the engine, with two of the rails connected to two fuel injectors and the third high pressure rail connected to four fuel injectors. It is intended that the specification and examples be considered as exemplary only, with a true scope of the invention being indicated by the following claims.

What is claimed is:

1. A fuel system for an internal combustion engine, comprising:

at least four fuel injectors for supplying fuel to corresponding combustion chambers of the engine;

a pump assembly in fluid communication with the fuel injectors and supplying working fluid to the fuel injectors; and at least three high pressure rails fluidly connected between the pump assembly and the at least four fuel injectors.

2. The fuel system of claim 1, wherein at least two of the at least four fuel injectors are located on a first side of the engine, and at least two other of the at least four fuel injectors are located on an opposite, second side of the engine, and the at least three high pressure rails include at least four high pressure rails, at least two of which are located on the first side of the engine and at least another two of which are located on the second side of the engine.

3. The fuel system of claim 2, wherein at least two high pressure rails are fluidly connected to one another by at least one bridge line having an orifice formed therein.

4. The fuel system of claim 3, wherein at least another two high pressure rails are fluidly connected to one another by at least one bridge line having an orifice formed therein.

5. The fuel system of claim 2, wherein at least two high pressure rails are fluidly connected to one another by at least one fluid connection having two Helmholz resonance isolation valves.

6. The fuel system of claim 5, wherein at least another two high pressure rails are fluidly connected to one another by at least one fluid connection having two Helmholz resonance isolation valves.

7. The fuel system of claim 6, where each Helmholz resonance isolation valve includes a check valve and an orifice in parallel flow paths.

8. The fuel system of claim 2, wherein at least two high pressure rails share a common working fluid supply line extending from an outlet of the pump assembly, and at least another two high pressure rails share a common working fluid supply line extending from an outlet of the pump assembly.

9. The fuel system of claim 8, wherein at least one of the common working fluid supply lines includes a Helmholz resonance isolation valve located downstream of the pump assembly.

10. The fuel system of claim 9, wherein both of the common working fluid supply lines include a Helmholz resonance isolation valve located downstream of the pump assembly.

11. The fuel system of claim 10, where each Helmholz resonance isolation valve includes a check valve and an orifice in parallel flow paths.

12. The fuel system of claim 2, wherein each of the at least four high pressure rails includes a separate supply line connecting the high pressure rail to an outlet of the pump assembly.

13. The fuel system of claim 1, wherein the pump assembly includes a single pump unit.

14. The fuel system of claim 1, wherein the working fluid is fuel.

15. The fuel system of claim 1, wherein the working fluid is hydraulic oil.

16. A method for reducing pressure fluctuations in a fuel system of an internal combustion engine, comprising:

supplying working fluid from a high pressure pump assembly to at least three high pressure rails; and passing working fluid from the at least three high pressure rails to fuel injectors of the engine.

17. The method of claim 16, wherein the supplying of working fluid to at least three high pressure rails includes supplying working fluid to at least four high pressure rails, at least two of which are located on a first side of the engine, and at least two other of which are located on an opposite, second side of the engine, and the passing of working fluid to the fuel injectors of the engine includes passing working fluid from the at least four high pressure rails to the fuel injectors of the engine.

18. The method of claim 17, further including passing working fluid between at least two high pressure rails through at least one bridge line having an orifice formed therein.

19. The method of claim 18, further including passing working fluid between at least another two high pressure rails through at least one bridge line having an orifice formed therein.

20. The method of claim 17, further including passing working fluid between at least two high pressure rails through at least one fluid connection having two Helmholz resonance isolation valves.

21. The method of claim 20, further including passing working fluid between at least another two high pressure rails through at least one fluid connection having two Helmholz resonance isolation valves.

22. The method of claim 17, further including supplying working fluid to at least two high pressure rails from the outlet of the pump assembly through a first common working fluid supply line, and supplying working fluid to at least another two high pressure rails from the outlet of the pump assembly through a second common working fluid supply line.

23. The method of claim 22, further including supplying working fluid to at least one of the first and second common working fluid supply lines through a Helmholz resonance isolation valve located downstream of the pump assembly.

24. The method of claim 23, further including supplying working fluid to both the first and second common working fluid supply lines through a Helmholz resonance isolation valve located downstream of the pump assembly.

25. The method of claim 17, wherein said passing of working fluid from the at least four high pressure rails to the fuel injectors of the engine includes serially alternating the passing of working fluid to a fuel injector between each of the at least four high pressure rails.

26. The method of claim 16, wherein the supplying of working fluid to the at least three high pressure rails includes separately supplying working fluid to each high pressure rail through individual lines connecting each high pressure rail to an outlet of the pump assembly.

27. The method of claim 16, wherein the working fluid is fuel.

28. The method of claim 16, wherein the working fluid is hydraulic oil.

29. A method for supplying working fluid through a group of fluid control valves of an internal combustion engine, comprising:

supplying working fluid from a high pressure pump assembly to at least a first, second and third high pressure rail; and passing a first portion of the working fluid from the first high pressure rail through a fluid control valve of a first group of fluid control valves;

passing a second portion of the working fluid from the second high pressure rail through a fluid control valve of a second group of fluid control valves after said passing of the first portion of the working fluid through a fluid control valve of the first group of fluid control valves; and passing a third portion of the working fluid from the third high pressure rail through a fluid control valve of a third group of fluid control valves after said passing of the second portion of the working fluid through a fluid control valve of the second group of fluid control valves.

30. The method for supplying working fluid according to claim 29, further including supplying working fluid from the high pressure pump assembly to a fourth high pressure rail, and passing a fourth portion of the working fluid from the fourth high pressure rail through a fluid control valve of a fourth group of fluid control valves after said passing of the third portion of the working fluid through a fluid control valve of the third group of fluid control valves.

31. The method of claim 30, further including passing working fluid between the first and third high pressure rails through at least one bridge line having an orifice formed therein.

32. The method of claim 31, further including passing working fluid between the second and fourth high pressure rails through at least one bridge line having an orifice formed therein.

33. The method of claim 29, wherein each of said fluid control valves are a component of a fuel injector.

34. The method of claim 29, wherein the working fluid is fuel.

35. The method of claim 29, wherein the working fluid is hydraulic oil.

36. A fuel system for an internal combustion engine, comprising:

at least four fuel injectors for supplying fuel to corresponding combustion chambers of the engine, at least two of the at least four fuel injectors being located on a first side of the engine, and at least two other of the at least four fuel injectors being located on an opposite, second side of the engine;

a pump assembly in fluid communication with the fuel injectors and supplying fuel to the fuel injectors; and at least four high pressure rails fluidly connected between the pump assembly and the at least four fuel injectors, at least two of the at least four high pressure rails being located on the first side of the engine and at least another two of the at least four high pressure rails being located on the second side of the engine.

37. The fuel system of claim 36, wherein the at least two high pressure rails located on the first side of the engine are fluidly connected to one another by at least one bridge line having an orifice formed therein.

38. The fuel system of claim 37, wherein the at least two high pressure rails located on the second side of the engine are fluidly connected to one another by at least one bridge line having an orifice formed therein.

39. The fuel system of claim 36, wherein the at least two high pressure rails located on the first side of the engine are fluidly connected to one another by at least one fluid connection having two Helmholz resonance isolation valves.

40. The fuel system of claim 39, wherein the at least two high pressure rails located on the second side of the engine are fluidly connected to one, another by at least one fluid connection having two Helmholz resonance isolation valves.

41. The fuel system of claim 40, where each Helmholz resonance isolation valve includes a check valve and an orifice in parallel flow paths.

42. The fuel system of claim 36, wherein the at least two high pressure rails on the first side of the engine share a common working fluid supply line extending from an outlet of the pump assembly, and the at least two high pressure rails on the second side of the engine share a common working fluid supply line extending from an outlet of the pump assembly.

43. The fuel system of claim 42, wherein at least one of the common working fluid supply lines includes a Helmholz resonance isolation valve located downstream of the pump assembly.

44. The fuel system of claim 43, wherein both of the common working fluid supply lines include a Helmholz resonance isolation valve located downstream of the pump assembly.

45. The fuel system of claim 44, where each Helmholz resonance isolation valve includes a check valve and an orifice in parallel flow paths.

46. The fuel system of claim 36, wherein each of the at least four high pressure rails includes a separate supply line connecting the high pressure rail to an outlet of the pump assembly.

* * * * *